United States Patent [19]

Strybel

[11] Patent Number: 4,827,755

[45] Date of Patent: May 9, 1989

[54] MANUALLY OPERABLE SWIVEL TUBE BENDER

[75] Inventor: Richard V. Strybel, Elk Grove Village, Ill.

[73] Assignee: Clevite Industries Inc., Cleveland, Ohio

[21] Appl. No.: 153,886

[22] Filed: Feb. 9, 1988

Related U.S. Application Data

[63] Continuation of Ser. No. 918,236, Oct. 14, 1986, abandoned.

[51] Int. Cl.[4] ..... B21D 11/04

[52] U.S. Cl. ..... 72/458; 72/388; 72/459

[58] Field of Search ..... 72/458, 459, 457, 388, 72/216, 217, 149, 154, 319, 387

[56] References Cited

U.S. PATENT DOCUMENTS

| | | | |
|---|---|---|---|
| 1,075,837 | 10/1913 | Malo et al. | 72/459 |
| 1,324,670 | 12/1919 | Hawes | 72/459 |
| 2,864,272 | 12/1958 | Swanson | 72/459 |
| 2,908,193 | 10/1959 | Gryniewicz | 72/388 |
| 2,979,976 | 4/1961 | Franck | 72/459 |
| 3,190,105 | 8/1972 | Strybel | 72/459 |
| 3,685,335 | 6/1965 | Kowal | 72/319 |
| 4,403,496 | 9/1983 | Kowal | 72/388 |

FOREIGN PATENT DOCUMENTS

| | | | |
|---|---|---|---|
| 0883406 | 11/1961 | United Kingdom | 72/388 |

*Primary Examiner*—David Jones

*Attorney, Agent, or Firm*—Russell E. Baumann

[57] ABSTRACT

A tube bender having a swivel connection of the handle to the shoe for facilitating readjustment of the handle in providing tube bends of greater than 90°, while avoiding crossover of the tube handle with the mandrel handle. The shoe handle includes a cylindrical extension rotatably received in a socket in the shoe and structure is provided for automatically disposing the handle in either of preselected dispositions. The extension is caused to be disposed in an overcenter arrangement in the preselected dispositions so as to cause forces generated on the shoe handle during the bending operation to more firmly lock the handle in the preselected disposition. A friction washer is provided for biasing the shoe handle to provide releasable retention thereof in the preselected positions.

12 Claims, 1 Drawing Sheet

MANUALLY OPERABLE SWIVEL TUBE BENDER

This is a continuation of application Ser. No. 918,236, filed on Oct. 14, 1986, now abandoned

TECHNICAL FIELD

This invention relates to tube benders and in particular to manually operable tube benders having a pair of manually graspable handles for moving a bending shoe relative to a bending mandrel.

BACKGROUND ART

One improved form of manually operable tube bender is disclosed in U.S. Pat. No. 3,685,335 of Leonard J. Kowal. As shown thereimn, a mandrel is provided with a peripheral arcuate groove into which a tube to be bent is urged by a cooperating shoe. The shoe is swingably mounted in association with the mandrel and is moved by means of a handle extending outwardly therefrom. The mandrel, in turn, is supported on a second handle rigidly connected thereto, and in the tube forming operation, the first handle is brought from a start position wherein it extends generally perpendicularly to the second handle to a final position wherein the grasping portion thereof is disposed adjacent the grasping portion of the second handle.

It is desirable to limit the swing of the first handle so as to avoid a crossover between the handles in effecting the desired bend. Such limitation restricts the amount of movement of the shoe about the mandrel groove. It has been proposed to incorporate, in the tube bender, means for permitting the first handle to be repositioned from the initial end position adjacent the grasping portion of the first handle so as to permit a further travel of the bending shoe about the mandrel by effecting a subsequent movement of the first handle similarly to the initial movement thereof between the bend start location and the position adjacent the second handle grasping means. Thus, a bend of up to 180° may be effected with such structure without losing the desirable leverage and thereby permitting the bending of relatively rigid tubing.

U.S. Pat. No. 2,979,976 and 3,190,105 attempt to provide this feature in the prior art. The benders disclosed in these patents, however, suffer from the problems of being complex in design and thus more expensive to manufacture. Further, U.S. Pat. No. 2,979,976 discloses a manual locking mechanism which is cumbersome to use while U.S. Pat. No. 3,190,105 discloses a bender design in which the operation of repositioning the handle requires more care and control.

DISCLOSURE OF INVENTION

The present invention comprehends a tube bender having improved means for permitting repositioning of the first handle when desired so as to permit extended bending of the tube in the mandrel groove, such as up to approximately 180°.

The invention comprehends the provision of means connecting the first handle to the shoe, permitting swiveling thereof between any one of a plurality of preselected positions, and in the illustrated embodiment, the handle connecting means provides for two preselected swiveled positions of the first handle relative to the shoe.

The illustrated handle includes an end portion rotatably received in a socket provided in the shoe. The means for retaining the handle end in the socket further defines the means for providing the preselected positioning of the handle.

In the illustrated embodiment, the grasping portion of the first handle extends at an angle of approximately 65° to the end portion received in the socket.

In the illustrated embodiment, the end portion of the first handle is rotatable 180° in the socket in providing the two preselected positions of the grasping portion of the handle.

Resiliently biased friction are provided for retaining the first handle in either of the preselected positions.

The means for connecting the first handle to the shoe includes overcenter means for causing the first handle to be effectively held in the selected preselected disposition as a result of application of tube bending force to the first handle.

The tube bender structure of the invention is extremely simple and economical of construction, provides automatic self-locking of the handle in the desired dispositions, provides improved swiveling means for extended useful life and esthetics, and provides controlled, smooth operation in effecting the tube bend.

BRIEF DESCRIPTION OF THE DRAWING

Other features and advantages of the invention will be apparent from the following description taken in connection with the accompanying drawing wherein.

BEST MEANS FOR CARRYING OUT THE INVENTION

Figure 1:
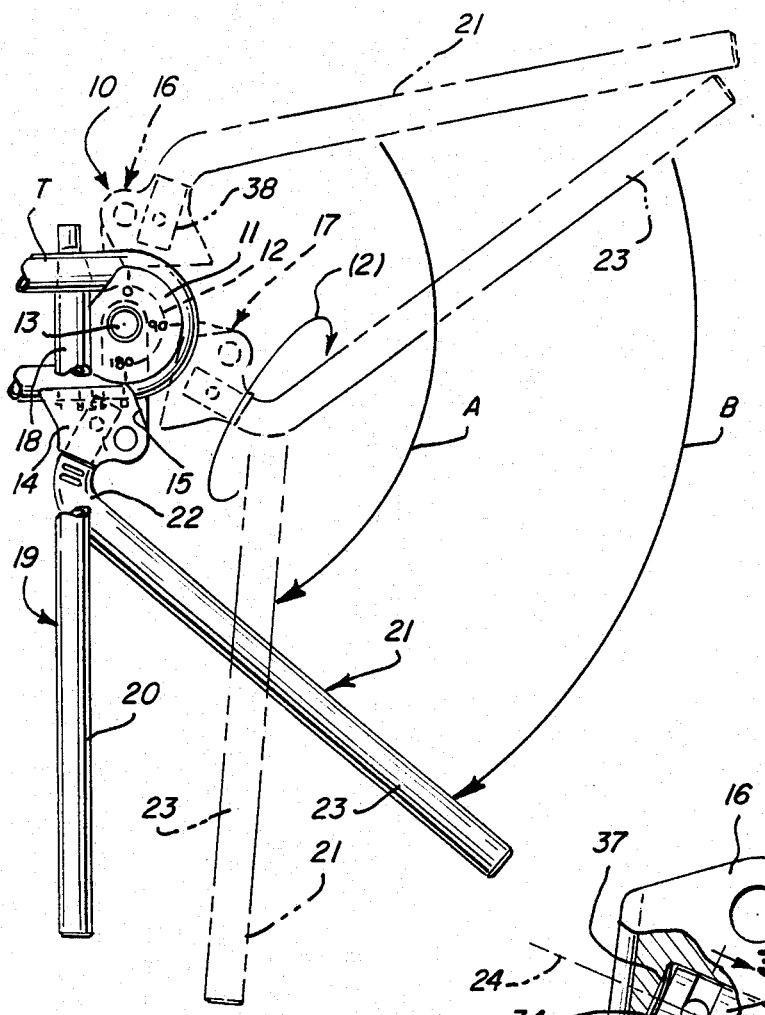
FIG. 1 is a side elevation of a tube bender structure embodying the invention, with the handle connected to the shoe being shown in different positions in broken lines.

In the illustrative embodiment of the invention as disclosed in the drawing, a tube bender generally designated 10 is shown to include a mandrel 11 having a peripheral tube bending groove 12 extending concentrically about an axis 13 of the mandrel.

A tube bending shoe 14 is swingably connected to the mandrel by a link 15 for concentric movement about axis 13 in pressing a tube T to be bent progressively into the groove 12 as a result of swinging of the shoe from a bend start position 16 to a bend position 17 of approximately 90°, as seen in FIG. 1.

The present invention is concerned with providing means for permitting the tube bender to be used in extending the tube bend beyond 90°, such as up to approximately 180° with improved facility.

More specifically, the mandrel is fixedly secured to an end 18 of a first handle 19 having a grasping portion 20 at the end opposite end 18. Shoe 16 is caused to move about the mandrel by means of a second handle 21 having an end 22 connected to the shoe and a grasping portion 23 at the end opposite end 22.

Figure 2:
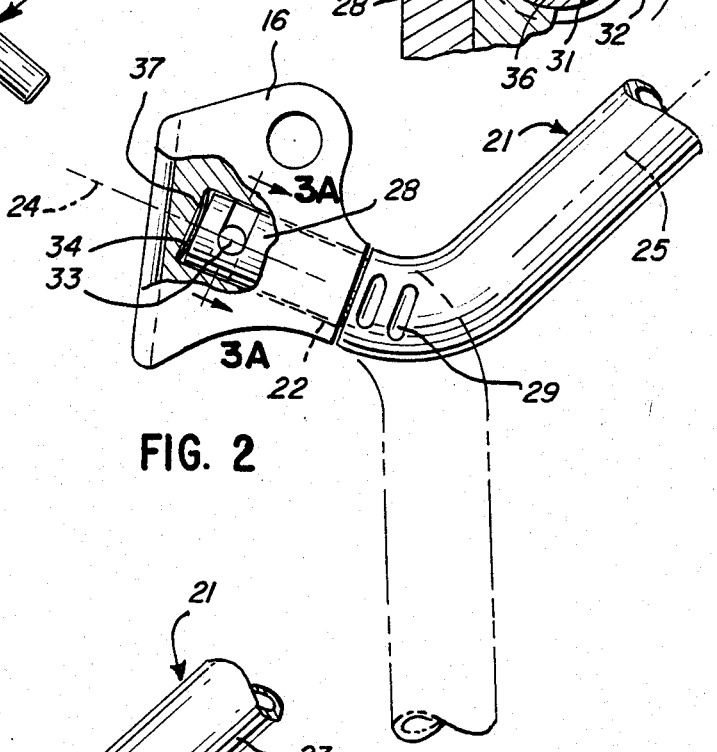
FIG. 2 is a fragmentary enlarged side elevation, with portions broken away illustrating the connection of the handle to the shoe in greater detail.

Handle end 22 defines a longitudinal axis 24 and grasping portion 23 defines a longitudinal axis 25. As best seen in FIG. 2, axis 25 extends at an angle of approximately 115° to axis 24.

Figure 4:
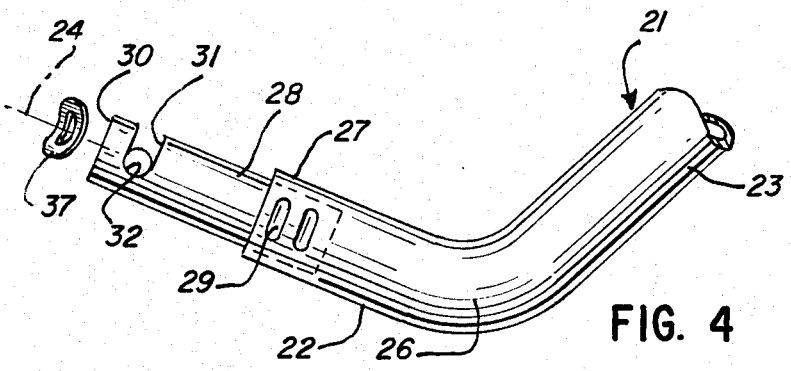
FIG. 4 is a fragmentary exploded side elevation of the handle connecting means, with the shoe structure omitted.

In the illustrated embodiment, handle end 22 includes an arcuate portion 26 and a rectilinear, distal end portion 27. As seen in FIG. 4, the handle is tubular and a cylindrical extension 28 is fitted into the distal end 27. Extension 28 is rigidly secured to the handle end portion 27 by suitable crimping 29.

Adjacent its distal end 30, extension 28 is provided with a chordal slot 31 extending approximately three-quarters through the transverse extent of the extension. The inner end 32 of slot 31 is arcuate and is adapted to snugly receive a locking pin 33.

Figure 3B:
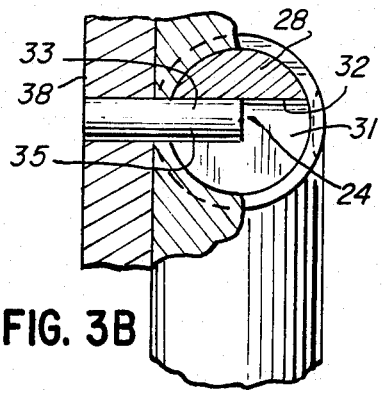
FIG. 3B is a view similar to that of FIG. 3A, but with the handle in the dotted line position of FIG. 2.
Figure 3A:
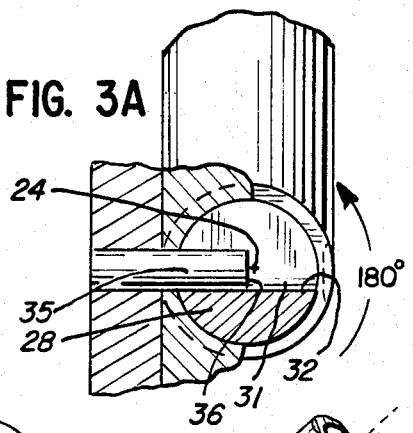
FIG. 3A is a fragmentary transverse section taken substantially along the line 3—3 of FIG. 2.

As best seen in FIG. 2, handle extension 28 is rotatably received in a cylindrical socket 34 in shoe 16 for rotation about axis 24. The shank 35 of pin 33 extends less than halfway through the extension slot 31, as illustrated in FIGS. 3A and 3B. In swinging about axis 24, bottom 32 of slot 31 is brought around the distal end 36 of shank 35 so as to be selectively disposed in the alternative positions of FIG. 3A and 3B 180° apart. In the illustrated embodiment, the rotation is slightly more than 180° so as to dispose the handle slightly over center in each of the preselected end positions, whereby a force generated through the handle in urging the shoe about the mandrel axis 13 in the bending operation tends to lock the handle in the preselected position.

The handle is further releasably retained in the selected position by means of a spring water 37 received in the bottom of socket 34 and resiliently urging the extension portion of the handle longitudinally outwardly against the side of locking pin shank 35.

Pin 33 is force-fitting through the side of the shoe, as illustrated in FIGS. 3A and 3B, and is pressed in flush with the outside surface 38 for accurately positioning the inner end 36 to permit maximum seating of the extension 28 on the side of the pin in the selected dispositions of FIGS. 3A and 3B, while yet permitting the swinging of the slot end 32 around the distal end of the pin.

As shown, the swiveling means is recessed within the shoe for minimized maintenance requirements and long troublefree life. That is, the swiveling means is protected from contamination and not open as in prior art devices.

In use, the handle 21 is firstly arranged, as shown in broken lines at the top of FIG. 1, and the shoe 16 manipulated on link 15 to bring the shoe against the tube T to be bent in groove 12 of the mandrel. Shoe 16 is then swung about axis 13 of the mandrel by movement of the handle 21 from the bend start position an angular distance A to approximately a 90° bend position wherein the handle grasping portion 23 is juxtaposed to the grasping portion 20 of handle 19. To provide a bend of over approximately 90°, the user need merely swivel handle 21 about the axis 24 of extension 28 so as to bring the grasping portion 23 again back to adjacent the original bend start position, whereupon further swinging of the shoe about axis 13 of the mandrel may be effected over the angle B to a final bend position illustrated in full lines in FIG. 1 and wherein the tube is bent approximately 180°, as shown therein.

While the handle 21 is effectively retained in the preselected dispositions by the overcenter arrangement during the bending operation, the handle may be readily rotated between the two preselected positions about axis 24 of the extension 28 against the releasable biasing action of the spring washer 37 in positioning the extension portion 28 in either of the desired selected positions of FIGS. 3A and 3B.

The improved swingable handle of the present invention provides automatic preselection of the handle dispositions with a self-locking feature assuring that the handle be retained in the desired preselected position during the bending operation. The complete enclosure of the swivel mechanism provides long, troublefree extended life. The loading of the swivel by means of the spring washer provides controlled smooth adjustment. The swivel structure is extremely simple and economical of construction while yet providing the highly desirable functioning discussed above.

The foregoing disclosure of specific embodiments is illustrative of the broad inventive concepts comprehended by the invention.

I claim:

1. In a tube bender having a mandrel defining an axis and having a peripheral radially outwardly opening tube-receiving groove concentric to said axis, a tube bending shoe, means connecting the shoe to the mandrel for movement about said axis adjacent said groove, and a first handle having a grasping portion and an end fixed to said mandrel, the improvement comprising:

a second handle having a grasping portion defining a longitudinal axis and having an end; and connecting means defining a longitudinal axis for rotatably connecting said second handle end to said shoe comprising means for preselected controlled positioning of said handle on any one of a plurality of preselectively fixed different dispositions directed outwardly from said shoe to permit a plurality of similar swinging movements of said second handle grasping portion toward the first handle grasping portion from a start location in moving said shoe in a corresponding plurality of successive movements seriatim about said axis thereby providing for accurate controlled bending of tubes in operation; said connecting means axis being at an angle to grasping portion axis.

2. The tube bender structure of claim 1 wherein said connecting means comprises a socket in said shoe, a distal portion of said second handle defining said longitudinal axis of said connecting means and being received in said socket for selective positioning about said longitudinal axis.

3. The tube bender structure of claim 1 wherein said connecting means longitudinal axis and said second handle portion longitudinal axis extend at an angle of approximately 115 to each other.

4. The tube bender structure of claim 1 wherein said longitudinal axis are disposed only in first and second preselected angularly related dispositions.

5. The tube bender structure of claim 1 wherein said first and second preselected angularly related dispositions are approximately 180° apart.

6. The tube bender structure of claim 1 wherein said connecting means comprises means for rotatably locking said end of the second handle to said shoe.

7. In a tube bender having a mandrel defining an axis and having a peripheral radially outwardly opening tube-receiving groove concentric to said axis, a tube bending shoe means connecting the shoe to the mandrel for movement about said axis adjacent said groove, and a first handle having a grasping portion and an end fixed to said mandrel, the improvement comprising:

a second handle having a grasping portion and an end; and connecting means for preselected adjustably fixed rotatably connecting said end of said second handle to said shoe about the second handle axis to dispose said grasping portion thereof in either of two preselected dispositions approximately 180° apart while still providing for accurate controlled bending of the tubes in operation.

8. The tube bender structure of claim 7 wherein said second handle end is rotatably received in a socket in said shoe.

9. The tube bender structure of claim 7 including means for rigidly securing said second handle grasping portion to said second handle end.

10. The tube bender structure of claim 7 further providing means associated with said second handle for releasably retaining the second handle in said preselected disposition.

11. The tube bender structure of claim 7 wherein said connecting means comprises overcenter means for causing said second handle to be effectively held in the selected preselected disposition as a result of application of tube-bending force to said second handle.

12. In a tube bender having a mandrel defining an axis and having a peripheral radially outwardly opening tube-receiving groove concentric to said axis, a tube-bending shoe, means connecting the shoe to the mandrel for movement about said axis adjacent said groove, and a first handle having a grasping portion and an end fixed to said mandrel, the improvement comprising:

a second handle having a grasping portion and an end;

connecting means for preselected adjustably fixed rotatably connecting said second handle end to said shoe about the second handle axis to dispose said grasping portion thereof in either of two preselected dispositions approximately 180° apart while still providing for accurate controlled bending of the tubes in operation, and resiliently biased friction means associated with said second handle for releasably retaining the second handle in said preselected dispositions.

* * * * *